US006778055B1

(12) United States Patent
Wang

(10) Patent No.: US 6,778,055 B1
(45) Date of Patent: Aug. 17, 2004

(54) CORE MEMBER FOR WINDING

(75) Inventor: David Wang, Chung Li (TW)

(73) Assignee: Aoba Technology Co., Ltd., Chung Li (TW)

( * ) Notice: Subject to any disclaimer, the term of this patent is extended or adjusted under 35 U.S.C. 154(b) by 6 days.

(21) Appl. No.: 10/359,646

(22) Filed: Feb. 7, 2003

(51) Int. Cl.[7] ..... H01F 27/02
(52) U.S. Cl. ..... 336/83; 336/65; 336/208
(58) Field of Search ..... 336/65, 83, 208, 336/192; 29/602.1

(56) References Cited

U.S. PATENT DOCUMENTS 6,154,112 A * 11/2000 Aoba et al. ..... 336/192
6,223,419 B1 * 5/2001 Abramov ..... 29/602.1
6,348,850 B1 * 2/2002 Kimura et al. ..... 336/200
6,373,366 B1 * 4/2002 Sato et al. ..... 336/192
6,449,830 B1 * 9/2002 Amada et al. ..... 29/605
6,522,230 B2 * 2/2003 Hanato et al. ..... 336/83
6,535,095 B2 * 3/2003 Aoki et al. ..... 336/83

* cited by examiner

*Primary Examiner*—Anh Mai
(74) *Attorney, Agent, or Firm*—Troxell Law Office PLLC

(57) ABSTRACT

A core member for winding is disclosed having a main body and two end flanges at two ends of the main body, each end flange having a top step above the elevation of the topmost edge of the main body and two upright legs vertically upwardly protruded from the step in an offset position.

1 Claim, 4 Drawing Sheets

CORE MEMBER FOR WINDING

BACKGROUND OF THE INVENTION

1. Field of the Invention

The present invention relates to an electric winding and, more specifically, to a core member for winding, which has a high structural strength and, supports the lead ends of the enameled wires positively in position, preventing a short circuit between two enameled wires.

2. Description of the Related Art

FIG. 1 illustrates a core member for winding according to the prior art. As illustrated, the core member has a main body 1' and two end flanges 2' and 3' at the ends of the main body 1'. The end flanges 2' and 3' each have two upright legs 21' and 22'; 31' and 32' bilaterally disposed at the top and spaced by a gap 4' or 5'. Further, electrodes 211', 221', 311', and 321' are fixedly located on the upright legs 21' and 22'; 31' and 32' at the top. Referring also to FIG. 2, a first enameled wire 6' and a second enameled wire 7' are respectively wound round the main body 1', and electrically connected to the electrodes 211', 221', 311', and 321'. The lead ends of the first enameled wire 6' are respectively soldered to the electrodes 211' and 321'. The lead ends of the second enameled wire 7' are respectively soldered to the electrodes 221' and 311'. This design of core member for winding has drawbacks. The structural strength of the upright legs 21' and 22'; 31' and 32' are weak. The upright legs 21' and 22'; 31' and 32' may break easily when hit by an external object. Further, because the lead ends of the first enameled wire 6' are respectively suspended between the main body 1' and the respective electrodes 211' and 321', they tend to be forced to displace by an external force. If the insulation of the enameled wires 6' and 7' are broken, a displacement of the first enameled wire 6' may cause a short circuit.

SUMMARY OF THE INVENTION

The present invention has been accomplished under the circumstances in view. It is one object of the present invention to provide a core member for winding, which has a strong structural strength. It is another object of the present invention to provide a core member for winding, which supports the lead ends of installed enameled wires positively in position, preventing a short circuit between installed enameled wires. To achieve these and other objects of the present invention, the core member comprises a main body and two end flanges at two ends of the main body, the end flanges each having two upright legs bilaterally disposed at a top side and spaced by a gap, the upright legs each having a top side fixedly mounted with an electrode, wherein the end flanges each have a step vertically upwardly protruded from the elevation of the topmost edge of the main body to a predetermined height; the upright legs extend vertically upwardly from the steps of the end flanges in an offset position, each having a vertical inner side spaced from a vertical inner side of the respective step at a distance. The steps reinforce the structural strength of the upright legs, and enable the lead ends of the first enameled wire to be firmly supported in position at three bearing points.

DETAILED DESCRIPTION OF THE PREFERRED EMBODIMENT

Figure 1:
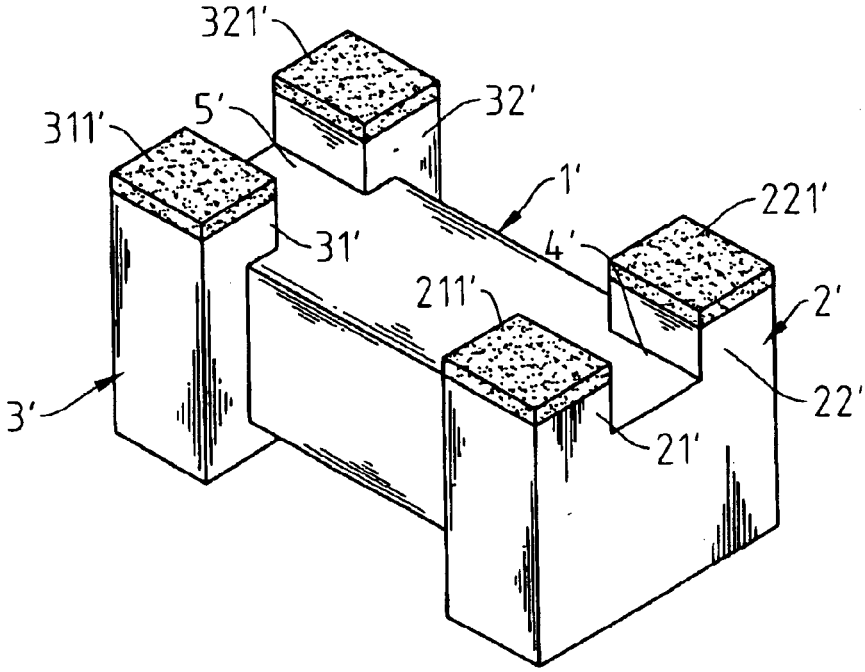
Fig. 1 Prior Art
FIG. 1 is an elevational view of a core member for winding according to the prior art.
Figure 2:
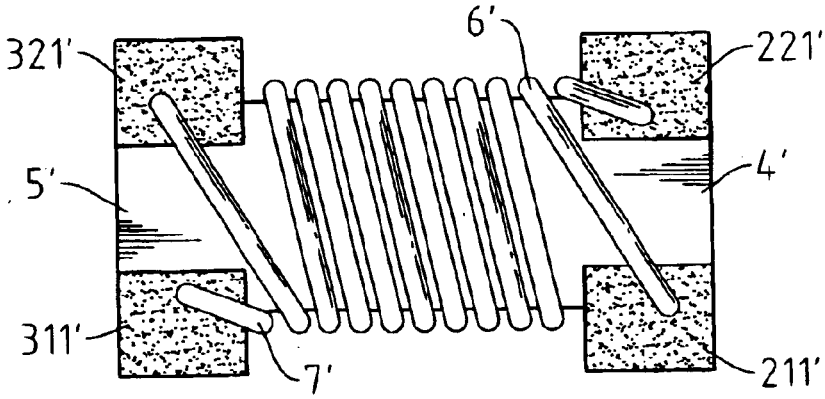
Fig. 2 Prior Art
FIG. 2 illustrates enameled wires installed in the core member according to the prior art.
Figure 3:
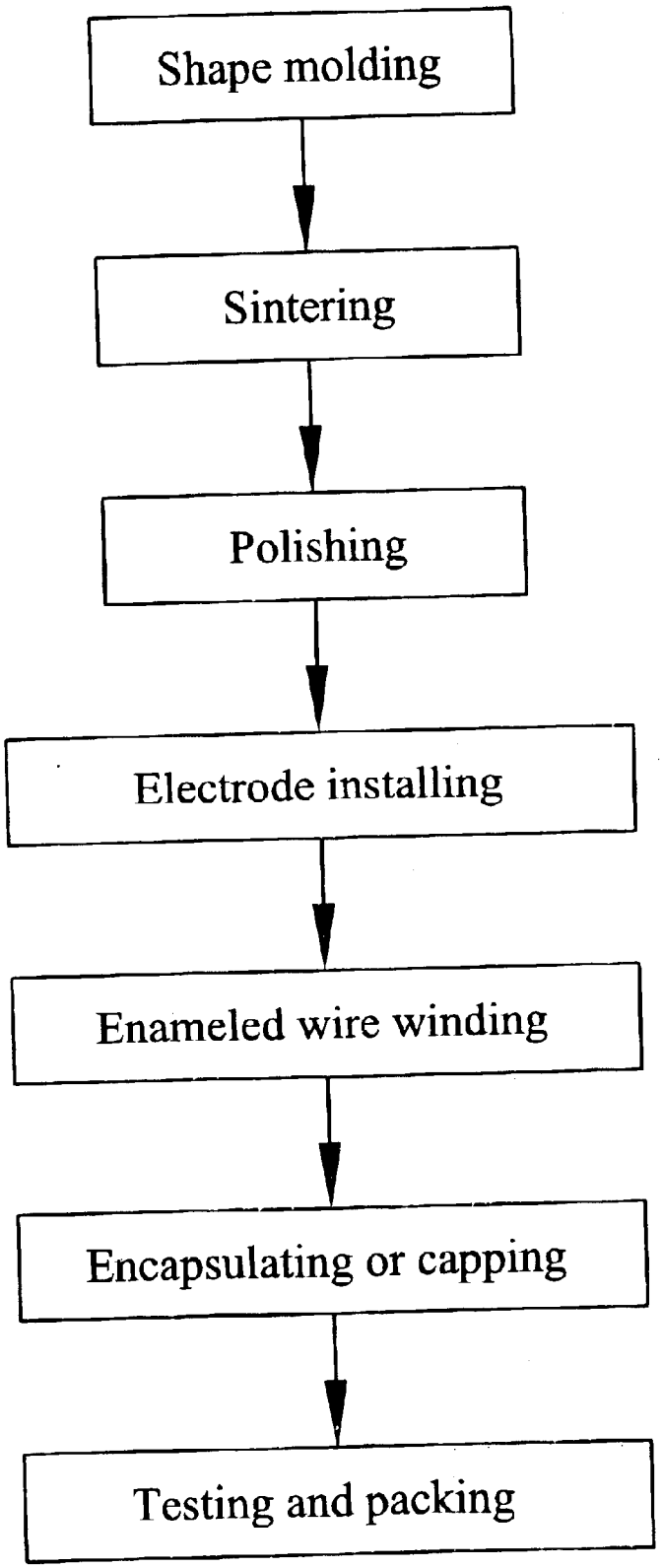
FIG. 3 is a block diagram showing an enameled wire fabrication flow according to the present invention.

Referring to FIG. 3, the fabrication of an electric winding comprises the steps of (a) molding a magnetic or electrically insulating material powder into a molding subject to a predetermined shape, (b) sintering the molding so as to obtain a core member, (c) polishing the core member, (d) fastening electrodes to the core member, (e) winding the core member with enameled wires and then soldering the lead ends of the enameled wires to the electrodes so as to obtain a raw winding, (f) encapsulating the raw winding with a resin or capping the raw winding with a cap, and (g) testing the encapsulated raw winding and then packing the winding.

Figure 4:
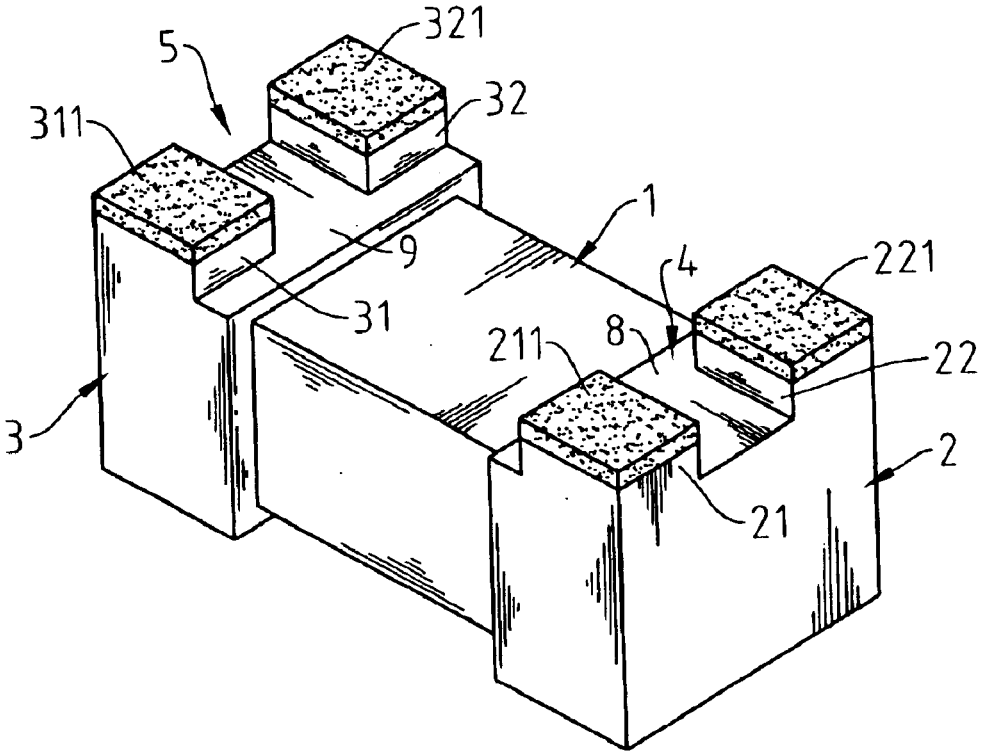
FIG. 4 is an elevational view of a core member for winding according to the present invention.
Figure 5:
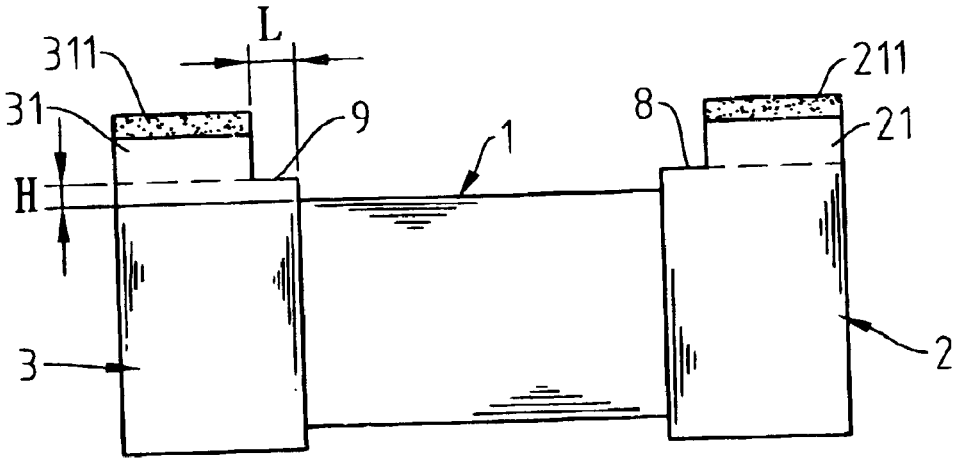
FIG. 5 is a plain view showing the structure of the core member according to the present invention.

Referring to FIGS. 4 and 5, a core member is shown having main body 1 and two end flanges 2 and 3 at the ends of the main body 1. The end flanges 2 and 3 each have a step 8;9 at the top, two upright legs 21 and 22;31 and 32 bilaterally upwardly extended from the step 8;9 and spaced by a gap 4;5. Electrodes 211, 221, 311, and 321 are respectively fixedly fastened to the upright legs 21, 22, 31, and 32 at the top. The steps 8 and 9 protrude vertically upwardly from the elevation of the top side of the main body 1 to a height H. The upright legs 21, 22, 31, and 32 have a respective vertical outer side respectively disposed in flash with the vertical outer sides of the end flanges 2 and 3, and a respective vertical inner side respectively disposed in an offset position relative to the steps 8 and 9 and spaced from the respective vertical inner side of the steps 8 and 9 at a distance L.

Figure 6:
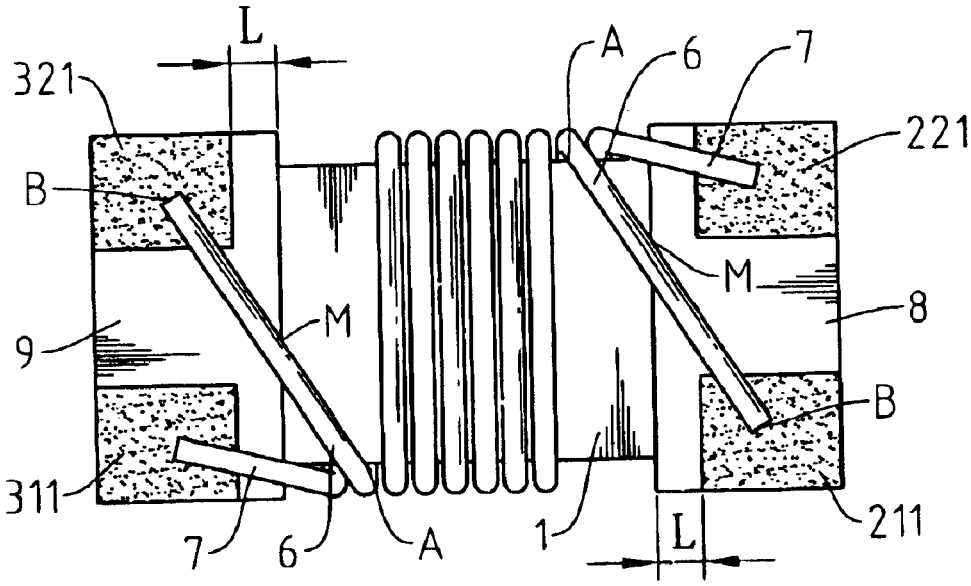
FIG. 6 illustrates enameled wires installed in the core member according to the present invention.

Referring to FIG. 6, a first enameled wire 6 and a second enameled wire 7 are respectively wound round the main body 1, and electrically connected to the electrodes 211, 221, 311, and 321. The lead ends of the first enameled wire 6 are respectively soldered to the electrodes 211 and 321. The lead ends of the second enameled wire 7 are respectively soldered to the electrodes 221 and 311.

Referring to FIG. 6 again, the steps 8 and 9 reinforce the structural strength of the upright legs 21, 22, 31, and 32. Further, because the steps 8 and 9 protrude vertically upwardly from the elevation of the top side of the main body 1 to a height H and the upright legs 21, 22, 31, and 32 have the respective vertical inner sides respectively disposed in an offsets position relative to the steps 8 and 9 and spaced from the respective vertical inner sides of the steps 8 and 9 at a distance L, the lead ends of the first enameled wire 6 is supported at three bearing points, namely, the inner bearing point A at the main body 1, the outer bearing point B at the electrode 211 or 321, and the middle bearing point M at one side edge of the step 8 or 9 adjacent to the main body 1. The three bearing points A, B, and M firmly support the lead ends of the first enameled wire 6 in position, preventing a displacement of the first enameled wire 6 and a short circuit between the first enameled wire 6 and the second enameled wire 7.

Although particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A core member comprising a main body and two end flanges at two ends of said main body, said end flanges each having two upright legs bilaterally disposed at a top side and spaced by a gap, said upright legs each having a top side fixedly mounted with an electrode, wherein said end flanges each have a step vertically upwardly protruded from the elevation of the topmost edge of said main body to a predetermined height; said upright legs extend vertically upwardly from the steps of said end flanges in an offset position, each having a vertical inner side spaced from a vertical inner side of the respective step at a distance.

* * * * *